US005636452A

United States Patent [19]

Thorp et al.

[11] Patent Number: 5,636,452

[45] Date of Patent: Jun. 10, 1997

[54] PAPER DRYING MACHINE AND METHOD FOR DRYING A PAPER WEB IN A PAPER DRYING MACHINE

[75] Inventors: Benjamin A. Thorp, Richmond, Va.; James Gilpatrick, Vancouver, Wash.

[73] Assignee: James River Corporation of Virginia, Richmond, Va.

[21] Appl. No.: 549,149

[22] Filed: Oct. 27, 1995

[51] Int. Cl.[6] ..... F26B 3/00

[52] U.S. Cl. ..... 34/452; 34/454

[58] Field of Search ..... 34/111, 115, 122, 34/130, 419, 444, 448, 452, 453, 454, 456, 457; 162/207, 297, 290, 115

[56] References Cited

U.S. PATENT DOCUMENTS

| | | | |
|---|---|---|---|
| 1,718,573 | 6/1929 | Millspaugh | 162/207 |
| 3,303,576 | 2/1967 | Sisson | 34/115 |
| 3,342,936 | 9/1967 | Cole et al. | 34/306 |
| 3,512,265 | 5/1970 | Fleissner | 34/115 X |
| 3,608,340 | 9/1971 | Fleissner | 34/115 X |
| 3,889,325 | 6/1975 | Fleissner | 34/115 X |
| 3,956,832 | 5/1976 | Justus | 34/115 X |
| 4,033,049 | 7/1977 | Schiel et al. | 34/115 X |
| 5,575,084 | 11/1996 | Vuorinen | 34/448 X |

*Primary Examiner*—John M. Sollecito
*Assistant Examiner*—Steve Gravini
*Attorney, Agent, or Firm*—Sixbey, Friedman, Leedom & Ferguson, P.C.; Charles M. Leedom, Jr.; Donald R. Studebaker

[57] ABSTRACT

A paper drying apparatus including a first rotatable drum, wherein the first rotatable drum has an inner perimeter and an outer perimeter and a second rotatable drum having an inner perimeter and an outer perimeter. A fabric sheet for carrying a paper web is provided, wherein the fabric sheet passes around the outer perimeter of the first rotatable drum and proceeds to next pass around the outer perimeter of the second rotatable drum. As the fabric sheet conveys the paper web around the first rotatable drum, a drying air is applied to the paper web in a direction from the inner perimeter of the first rotatable drum toward the outer perimeter of the first rotatable drum, further passing through the paper web. As the fabric sheet and paper web proceed around the second rotatable drum, a drying air is applied to the paper web in a direction from the outer perimeter of the second rotatable drum toward the inner perimeter of the second rotatable drum, further passing through the paper web in a similar direction.

4 Claims, 1 Drawing Sheet

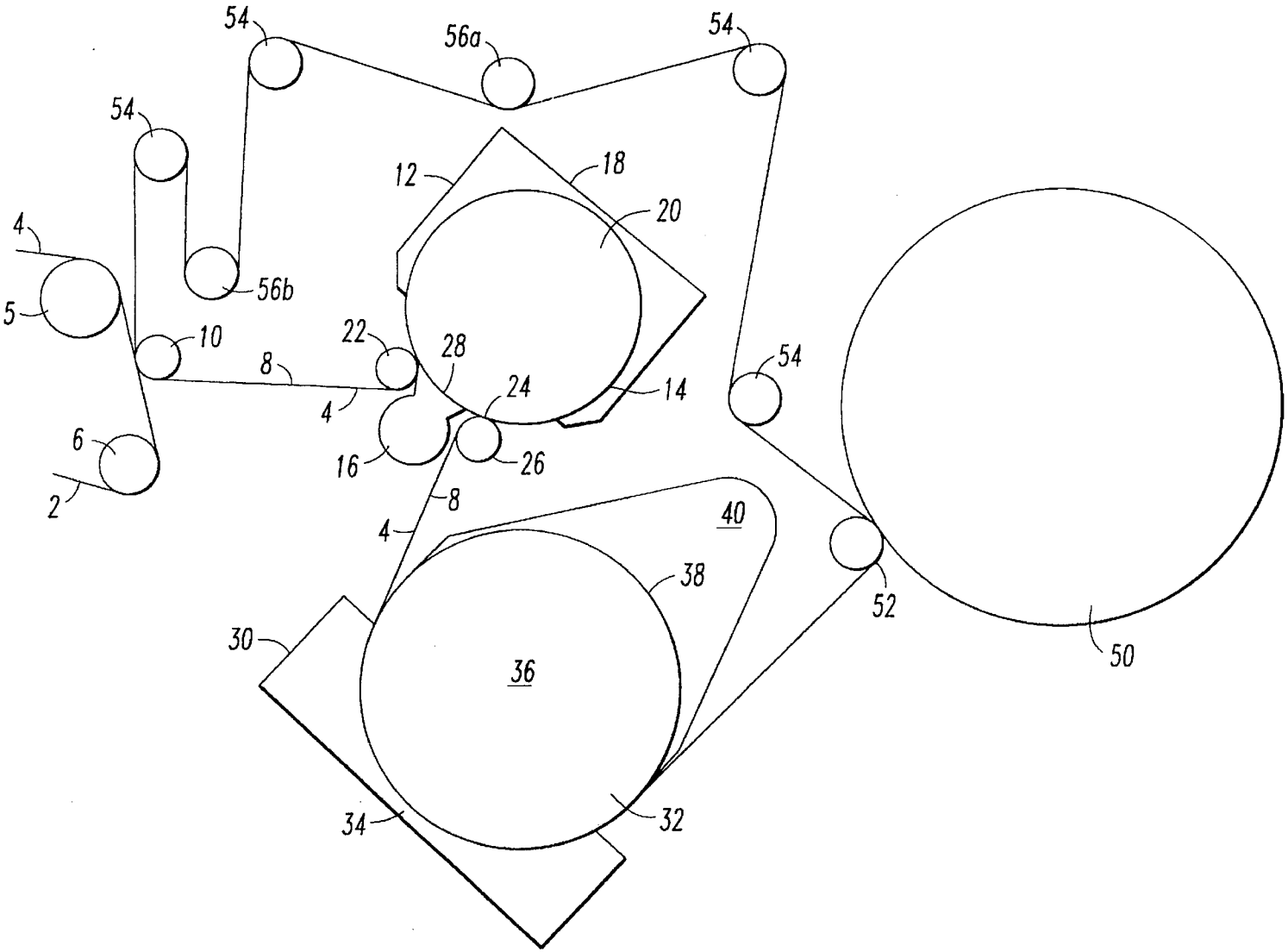
50
52
54
54
54
54
40
38
32
36
20
14
18
24
26
56a
28
8
12
22
16
4
34
4
30
56b
8
10
6
2
4
5

PAPER DRYING MACHINE AND METHOD FOR DRYING A PAPER WEB IN A PAPER DRYING MACHINE

BACKGROUND OF THE INVENTION

1. Technical Field

The present invention relates to a paper drying machine and a method of drying a paper web in a paper drying machine. More particularly, the invention pertains to a paper drying machine which employs through air drying of a paper web in two different directions.

2. Background Art

Paper products have conventionally been manufactured by forming a wet paper web on a fabric carrying sheet which then carries the paper web through a pressing section to remove the excess water from the web. After pressing the web to remove excess water, the paper web would then be fed to a separate drying section to fully remove the remaining moisture from the web. This step of pressing the web, however, did not function effectively with the presently required high-speed operation of such papermaking machines. Therefore, as opposed to leaving the web as a flat sheet on a single plane, rotatable steam-heated drum dryers over which the web traveled were utilized. The cost of supplying steam to these multiple drum dryers for heating the dryers is quite high and the ability to maintain uniform drum surface temperatures and humidity in the dryers is difficult. Accordingly, dryer hoods are widely used in connection with these rotary drums, wherein pressurized drying air, instead of steam, is introduced at various points in the hood to contact one exposed surface of the wet web as it progresses around the dryer with the exit path for the air being positioned on the other side of the rotary drum. This process is known as through air drying (TAD).

U.S. Pat. No. 3,432,936 issued to Sisson discloses one such drying assembly in which a moving stream of pressurized drying air is circulated about a paper web traveling about the periphery of a rotatable roll having apertures formed therein. Sisson utilizes a system where the hot drying air travels from the inside of the rotatable roll to the outside through the apertures, while the web travels about the outer surface of the roll. With such rotatable rolls usually being composed of metal, this inside-to-outside type drying requires smaller diameter rolls because the roll metal is on the hot side of the web, and larger diameter rolls create roll integrity problems with this inside-to-outside drying.

U.S. Pat. No. 3,432,936 issued to Cole et at. avoids the problems with inside-to-outside drying by employing a configuration which moves drying air from the exterior of a rotatable roll through the paper web and into the interior of the rotatable roll, otherwise known as outside-to-inside drying. This configuration positions the metal rotatable roll on the cool side of the paper web which allows larger diameter rotatable rolls to be used. However, when two or more of these rotatable rolls employing outside-to-inside drying are used, at least two carrying rolls must contact the paper web. As discussed earlier, whenever the paper web contacts a carrying roll machine runability problems as well as product quality problems are encountered.

One of the most important shortcomings associated with the above-described paper drying machine is that the paper web must come into contact with a carrying roll whenever more than one rotatable drying roll is employed. Further, machines which have one roll have limited drying capacity and are of limited commercial interest for that reason.

Moreover, prior art machines employing multiple drying rolls have the drying air traveling in the same direction in each of the drying rolls used in such a machine. However, the most efficient use of space in these machines would be to use a combination of inside-to-outside drying rolls with outside-to-inside drying rolls. U.S. Pat. No. 1,718,573 issued to Millspaugh discloses a paper making machine which discloses removing moisture from a paper web in an outside-to-inside fashion using a suction roll followed by an inside-to-outside removal of moisture by forcing steam through the paper web as it passes over a blower roll. It should be noted, however, that the device disclosed by Millspaugh utilizes steam with its blower roll, wherein the same problems discussed in the above prior art associated with using steam in a paper drying device are present in Millspaugh. Furthermore, it is economically more efficient and proficient to employ heated air rather than a combination of air and steam when using a blowing device to dry a wet paper web.

Therefore, as can be seen from the foregoing, there is clearly a pressing need for a paper drying machine which utilizes through-air-drying rolls of the above mentioned type, wherein the drying rolls employ two different directions of drying in order to make optimal use of space in the drying machine. Furthermore, there is a pressing need for a paper drying machine having no carrying rolls contacting the paper web, thus reducing any potential runability problems with the roll dryers.

SUMMARY OF THE INVENTION

It is a primary object of the present invention to overcome the aforementioned shortcomings associated with the prior art.

Another object of the present invention is to provide a paper drying apparatus which employs through-air-drying of a paper web in different directions in order to make optimal use of the available space in a drying apparatus.

Yet another object of the present invention is to provide a paper drying apparatus in which the paper web never contacts a carrying roll so that product quality is increased and machine runability problems may be avoided.

These as well as additional objects and advantages of the present invention are achieved by providing a paper drying apparatus including a first rotatable drum, wherein the first rotatable drum has an inner perimeter and an outer perimeter. The paper drying apparatus also includes a second rotatable drum having an inner perimeter and an outer perimeter, and fabric sheet for carrying a paper web, wherein the fabric sheet passes around the outer perimeter of the first rotatable drum and succeeds to next pass around the outer perimeter of the second rotatable drum. As the fabric sheet conveys the paper web around the first rotatable drum, drying air is applied to the paper web in a direction from the inner perimeter of the first rotatable drum toward the outer perimeter of the first rotatable drum and further passing through the paper web. As the fabric sheet and paper web proceed around the second rotatable drum, drying air is applied to the paper web in a direction from the outer perimeter of the second rotatable drum toward the inner perimeter of the second rotatable drum, and further passing through the paper web in a similar direction. After passing over the second rotatable drum, the fabric sheet then conveys the paper web toward a final drying drum where the paper web is transferred from the fabric sheet to the final drying drum through the use of a pressure roll.

These as well as additional advantages of the present invention will become apparent from the following description of the invention with reference to the figure.

BRIEF DESCRIPTION OF THE DRAWINGS

FIG. 1 is a schematic side view of the paper drying machine in accordance with a preferred embodiment of the present invention;

DETAILED DESCRIPTION OF THE PREFERRED EMBODIMENT

Referring now to FIG. 1, the paper drying apparatus in accordance with the present invention is illustrated for removing moisture from a wet paper web 4 which is the product of a paper making machine. The paper web 4 is carded from a paper making process to the drying device by a fabric sheet 2, wherein the fabric sheet travels about the perimeter of couch roller 5 and roller 6. In between rollers 5 and 6, the paper web 4 is contacted by and transferred to fabric sheet 8 as the fabric sheet 8 passes by pick up device 10. The fabric sheet 8 conveys the paper web 4 throughout the drying apparatus and forms a single loop through the drying apparatus and returning to the paper web transfer area at pick up shoe 10. Pick up device 10 may comprise a transfer roller, transfer shoe or any other structure to transfer the paper web 4 from fabric sheet 2 to fabric sheet 8. Such transfer devices often employ a vacuum to aid in the transfer of the paper web from one transfer fabric to another.

After the paper web 4 is transferred to the fabric sheet 8, the fabric sheet 8 carries paper web 4 into a first drying chamber 12. The drying chamber 12 comprises a rotatable drum 14, a heated air supply 16, and an exhaust area 18 for providing an exit for the heated air within the drying chamber 12. Rotatable drum 14 has a porous surface permeable to air so that the drying air provided by air supply 16 passes through the surface of the drum 14 and into the interior 20 of the drum 14. As the paper web 4 enters drying chamber 12, the paper web 4 passes between a carrier roll 22 and the rotatable drum 14. In order to minimize any machine downtime due to running problems, the wet paper web 4 does not contact carrier roll 22. Rather, the path of the fabric sheet 8 and paper web 4 is such that fabric sheet 8 contacts carrier roll 22 as the fabric sheet 8 and web 4 passes by carrier roll 22 while the paper web 4 abuts rotatable drum 14. Thereafter, the paper web 4 and fabric sheet 8 travel about the perimeter of the drum 14 as it rotates within drying chamber 12. After traveling about a substantial portion of the perimeter of the rotatable drum 14, the paper web 4 and fabric sheet 8 exit the first drying chamber 12 at 24, where the web and sheet pass between the rotatable drum 14 and a carrier roll 26. Similar to the path of the fabric sheet 8 as it enters drying chamber 12, fabric sheet 8 remains in contact with carrier roll 26 while paper web 4 is abutting rotatable drum 14. Carrier rolls 22 and 26 are positioned with respect to rotatable drum 14 to create additional tension in the fabric sheet 8 while passing through drying chamber 12 in order to maximize the contact between the paper web 4 and the surface of the rotatable drum 14. Additionally, the distance and angle of the fabric sheet 8 between pick up shoe 10 and carrier roll 22 can be adjusted to accommodate various sized rotatable drums for desired drying characteristics.

The drying chamber 12 employs through-air-drying (TAD) to remove moisture from the paper web 4 while it travels around the perimeter of the rotatable drum 14. The air supply 16 is situated between carrier rolls 22 and 26 so that the air supply 16 forces air into the interior 20 of drum 14 through a portion 28 of the rotatable drum I4 on which the fabric sheet 8 does not travel. The air then travels from the interior 20 of the drum 14 through the porous surface of the drum 14 toward the exhaust port 18 in drying chamber 12. Accordingly, as the air passes through the surface of the drum, the air is forced through the paper web 4 which is traveling about the surface of the rotatable drum 14. The path of the drying air is known as inside-to-outside TAD, because the air is traveling from the inside of the drum 14 to the outside of the drum 14 while it is removing moisture from the paper web 4. While the inside-to-outside drying air exits the rotatable drum 14 and passes through paper web 4, the air applies a force to lift the paper web 4 from the surface of the drum 14, wherein the tautness of the fabric sheet 8 resists this force and holds the paper web 4 in abutment to drum 14.

After leaving drying chamber 12, the fabric sheet 8 next carries the paper web 4 through a second drying chamber 30. Drying chamber 30 also includes a rotatable drum 32 which employs TAD to further dry the paper web 4; however, drying chamber 30 employs outside to inside drying air as opposed to the inside-to-outside drying air used in chamber 12. The fabric sheet 8 enters drying chamber 30 and travels about an outer surface of the rotatable drum 32, wherein the fabric sheet 8 is in abutment with the surface of rotatable drum 32. Drying chamber 30 includes a heated air supply 34 which forces heated air initially through the paper web 4 as the web 4 rotates through the drying chamber 30, then the air passes through the fabric sheet 8, and finally the air passes through the air permeable surface of the rotatable drum 32 into the interior 36 of the drum. After passing into the interior 36 of drum 32, the air passes through a portion 38 of rotatable drum 32 on which the fabric sheet 8 does not travel and exits the drying chamber 30 through an exhaust hood 40. The exhaust hood 40 extends around the portion 38 of the rotatable drum 32 from where the fabric sheet 8 enters rotatable drum 32 to where the fabric sheet 8 exits rotatable drum 32. While rotatable drum 32 may be similar in size to rotatable drum 14, rotatable drum 32 can be larger in diameter than drum 14 as the larger drum is generally more effective in removing moisture from the paper web 4 when using outside-to-inside drying air.

This arrangement of using one TAD roll with inside-to-outside drying air and another TAD roll with outside-to-inside drying air minimizes the space required for the drying apparatus and improves reliability, as the arrangement allows for the use of at least one large diameter drying roll without roll integrity problems. If strictly inside-to-outside drying was employed, then a large diameter roll could not be used due to the integrity problems caused by the drying roll being on the hot side of the paper web 4. The minimal space required for this double TAD roll configuration allows current paper drying machines to be adapted to include this improved configuration without having to move the large components in the drying process, such as the yankee dryer 50. Therefore, the operational downtime of a paper drying machine which would result from adapting the paper drying machine to incorporate this improved double TAD roll configuration would be minimal. Furthermore, since the second TAD roll employing outside-to-inside drying air may comprise almost any diameter, the second TAD roll may be selected to include a diameter which most adequately conforms to the spacial requirements of the paper drying machine while taking drying efficiency into account.

After travelling through the second drying chamber 30, the fabric sheet 8 conveys the paper web 4 from rotatable drum 32 to a final rotatable drying drum 50, conventionally known as a yankee or crepe dryer. The fabric sheet 8 and the paper web 4 proceed between the periphery of a pressure roll 52 and the drying drum 50, wherein the pressure roll 52 abuts the fabric sheet 8 and transfers the paper web 4 from the fabric sheet carrier to the perimeter of the drying drum 50. The paper web 4 then rotates along with the perimeter of drying drum 50 in a final drying procedure for the paper web 4. The fabric sheet 8 continues to travel about the perimeter of a series of carrier rolls 54 to return its loop back to the pick up shoe 10 and repeat the above stated process of drying the paper web 4. In addition, guide rolls 56*a* and 56*b* are adjustably mounted so that their position may be altered to modify the tension of the fabric sheet 8 as it travels through the drying loop.

The use of a single fabric sheet 8 in conveying the paper web 4 throughout the drying process increases the paper integrity by not transferring the paper web 4 to other conveying sheets while the paper web 4 is still in a substantially wet state, as transferring a wet paper web 4 to another conveying sheet can damage the integrity of the paper bonds and cause runability problems. Additionally, the fabric sheet 8 may be imprinted with a desired pattern which is formed in the paper web 4 as the wet paper web 4 conforms to the surface of the fabric sheet 8. As the paper web 4 is dried while being conveyed by the fabric sheet 8, this pattern is retained by the paper web 4. Therefore, using a single fabric sheet 8 to convey the paper web 4 through the drying process assists in forming this design pattern in the paper web, while transferring of the paper web to another conveying sheet would prevent the registering of the fabric imprint in the paper web.

Further, while the above description is limited to having a first TAD roll employing inside-to-outside drying and a second TAD roll employing outside-to-inside drying air, it is understood that both first and second TAD rolls may employ either inside-to-outside or outside-to-inside drying air.

As can be seen from the foregoing, a drying apparatus for a paper web constructed in accordance with the present invention will provide two TAD rolls with one TAD roll employing inside-to-outside drying air and the other TAD roll employing outside-m-inside drying air, thus making the most efficient use of space with two TAD drying rotIs without having roll integrity problems. Moreover, by constructing a paper drying apparatus in accordance with the present invention, the paper web travels through the paper drying apparatus without contacting any carrying rolls which will improve the paper product quality and diminish runability problems of the drying rolls.

While the present invention has been described with reference to a preferred embodiment, it should be appreciated by those skilled in the art that the invention may be practiced otherwise than as specifically described herein without departing from the spirit and scope of the invention. It is, therefore, to be understood that the spirit and scope of the invention be limited only by the appended claims.

What is claimed is:

1. A method for drying a paper web being carried on a fabric sheet comprising the steps of:

guiding the paper web toward a first rotatable drum using a first carrying roll so that only the fabric sheet contacts said first carrying roll;

passing the paper web over a first rotatable drum;

forcing air through the paper web in a first direction, said first direction being one of a direction from the inside of said first rotatable drum toward the outside of said first rotatable drum and the outside of the first rotatable drum toward the inside of the first rotatable drum;

guiding the paper web from said first rotatable drum toward a second rotatable drum using a second carrying roll so that only the fabric sheet contacts said second carrying roll;

passing the paper web over a second rotatable drum; and forcing air through the paper web about said second rotatable drum in a second direction, said second direction being opposite to the first direction.

2. The method of drying a paper web as defined in claim 1, wherein said first direction of forcing air through the paper web is from the inside of said first rotatable drum toward the outside of said first rotatable drum and said second direction is from the outside of the second rotatable drum toward the inside of the second rotatable drum.

3. The method of drying a paper web as defined in claim 1, further comprising directing said fabric sheet over carrying rolls when said fabric sheet enters and exits said first drying means in order to ensure the paper web is held in abutment to said first rotatable drum, wherein the paper web does not come into contact with said carrying rolls.

4. The method of drying a paper web as defined in claim 1, further comprising pressing and transferring the paper web from the fabric sheet to a rotatable drying drum after the fabric sheet exits said second drying means.

* * * * *